United States Patent [19]

Vinas

[11] 4,355,747

[45] Oct. 26, 1982

[54] MULTI-PURPOSE YARN FEEDING DEVICE

[75] Inventor: Juan Vinas, Middle Village, N.Y.

[73] Assignee: Textile Technology, Inc., White Plains, N.Y.

[21] Appl. No.: 97,735

[22] Filed: May 12, 1980

[51] Int. Cl.[3] ..... B65H 23/16

[52] U.S. Cl. ..... 226/34; 226/35; 66/132 T

[58] Field of Search ..... 226/34, 35, 190, 193, 226/183; 66/125 R, 126 R, 132 T, 132 R, 146; 242/129.2, 147 R, 47.01

[56] References Cited

U.S. PATENT DOCUMENTS

| | | | |
|---|---|---|---|
| 3,418,831 | 12/1968 | Nance | 66/132 T |
| 4,004,438 | 1/1977 | Raisin | 66/132 R |
| 4,090,677 | 5/1978 | Savio et al. | 242/47.01 |
| 4,114,823 | 9/1978 | Fecker et al. | 242/47.01 |

*Primary Examiner*—Leonard D. Christian
*Attorney, Agent, or Firm*—Myron Greenspan

[57] ABSTRACT

A multi-purpose yarn feeding device for knitting machines is described which includes a number of co-axially arranged rotary members which correspond to the number of yarns fed to the respective feeding station, each rotary member being provided with a frictionally yarn engaging circumferential periphery. Adjustably positionable eyelet guides are arranged to guide the incoming yarns towards and guide the outgoing yarns from the circumferential peripheries of the associated rotary members to result in yarn portions being in contact with preselected arcuate lengths of the circumferential periphery to thereby impart selected tractions to the yarns. A spring member having a fixed end and a hook for engaging a yarn portion is movable generally in the plane of an associated rotary member for selectively pulling away the yarn portion from the associated circumferential periphery of the rotary member. This modifies the extent of contact with the circumferential peripheries responsive to the tensions in the yarns to thereby modify the degrees of tractions imparted to the yarns and compensate for the externally applied tensions to the yarns. The feeding device can be used as a positive or compensating feeder for stripers and compensator feeder for Jaquards. Additionally, the device can also be used to feed elastomeric yarns. When the spring member is not utilized, the device can also be used as a conventional positive feeder.

18 Claims, 18 Drawing Figures

FIG. 1
PRIOR ART
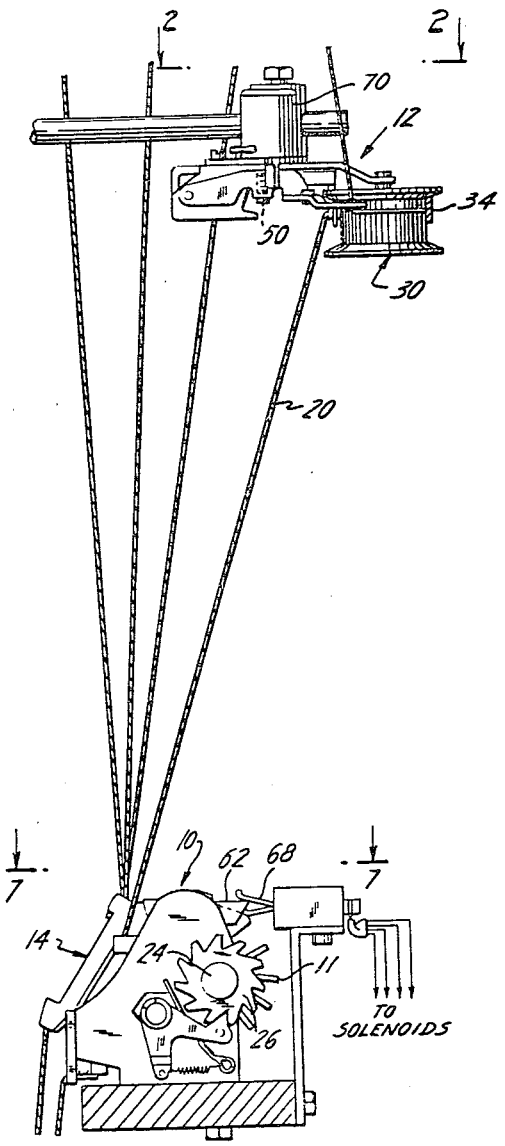
FIG. 2
PRIOR ART
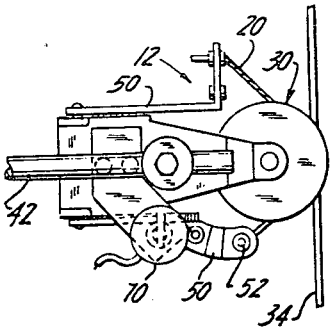
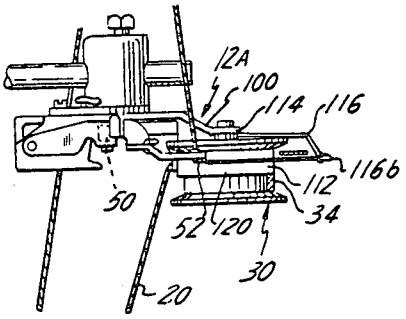
FIG. 3

MULTI-PURPOSE YARN FEEDING DEVICE

BACKGROUND OF THE INVENTION

The present invention generally relates to yarn feeding devices, and more particularly to a compensating and positive feed control device for knitting machines including Jacquards and striping machines.

Ideal feeding of yarns to the needles of a knitting machine is accomplished only when the tensions on the yarns at the knitting points remain uneffected regardless of the constant variations in feeding speed, and regardless of the extremely sharp or abrupt increases and decreases in tensions during the knitting operation, particularly with regard to Jaquards and striper styles. However, as the published prior art indicates, the solution has eluded many. Some of the prior approaches will now be examined.

A number of devices have been developed for holding a yarn reserve ready for the immediate yarn needs in knitting machines such that the yarn is fed with a very small practically constant tension to the knitting needles irrespective of the remaining quantity of yarn on the yarn cone and of the yarn tensions at the input to the feeding device. Such devices, commonly known as storage feeders, are typically of the type described in U.S. Pat. Nos. 3,225,446; 3,419,225; 3,490,710; 3,549,299; 3,625,444; 3,672,590; and 3,709,444. Typically, storage heaters use a spool or cylinder about which a quantity of yarn is wound and stored. The yarn is arranged so that the stored yarn can be released upon immediate demand with a very small and practically constant tension irrespective of the quantity of yarn remaining on the yarn bobbins or the tension of the yarn at the input to the device. However, while storage feeders have been suitable for use with circular knitting machines of the Jacquard-type, such storage feeders cannot be used as positive feeders since the outgoing yarn is not released at a predetermined constant rate but can vary considerably depending upon demand. Additionally, storage feeders are, for the most part, elaborate devices which are costly and large making them impractical for use on an extensive basis.

When more positive or controlled output feeding has been required, a typical approach has been to draw incoming yarn between two abutting rotary members at least one of which is driven in synchronism with the knitting machine. For example, in U.S. Pat. No. 1,970,242, the filament output feeding rate is controlled by passing the filament between driven and idler feed rollers. In U.S. Pat. No. 1,726,568, the positive feed device includes a pair of intermeshing gear wheels which feed the yarn between them by their rotation and exhibit the further feature that the rate of delivery may be changed by having the axis of one of the gear wheels moved. In this way, the degree of intermeshing of the gear wheels and thereby the rate of delivery of the yarn can be controlled. Another example of an attempt to provide variable rate feeding in positive feeders is disclosed in U.S. Pat. No. 1,097,115. There, cone-shaped friction wheels abut against each other, yarn passing between the friction wheels thereby being positively advanced. By selecting the axial portion on which the yarn is driven on the conical wheels, the rate of feed can thereby be controlled. While positive feeders increase the rate of feeding as the speed of the machine is increased, the rate of feeding is substantially synchronized to the speed of the machine and such positive feed mechanisms cannot be used to compensate feed. Accordingly, such devices are not suitable for many knitting applications including striping and Jacquard-type knitting.

Attempts at positive feeding have also been made in conjunction with the use of rollers or pulley wheels about which the yarns are at least partially suspended. Such a device has been proposed for feeding elastomeric yarns in U.S. Pat. No. 3,263,454. However, a problem with the approach described in the aforementioned patent, as well as in the other devices of this general type, is that proper operation is very sensitive to the degree of frictional engagement between the pulley and roller and the yarn. Too little friction between the particular pulley or wheel and the yarn is likely to result in slipping while excessive friction frequently results in the yarn wrapping around the pulley or wheel thereby jamming the mechanism thereby rendering it impractical in operation. In U.S. Pat. Nos. 3,090,215; 3,243,091 and 3,264,845, devices for guided feeding of yarn to knitting machines is disclosed which are in common use. The approach disclosed uses rollers arranged for rotation about parallel axes, a roller being provided at each feeding station about the periphery of the knitting machine. An endless tape is driven by a centrally arranged driving pulley and runs over the rollers between their end flanges. Since the tape is curved along at least a portion of the surface of each roller, disposing the yarn between the roller and the tape results in engagement with the yarn. However, because little pressure is applied by the belt to the yarn, and because only a small surface of contact exists between the tape and each of the rollers, the feed device is useful for positive feeding only at substantially low input tensions of up to approximately 15 grams. Because the magnitude of the frictional forces applied to the yarns are substantially fixed, slippage results when the tension forces exceed the frictional forces.

Still with reference to pulley or roller type positive feeders, a yarn feeding device is disclosed in U.S. Pat. No. 2,967,413. The device there disclosed is useful only for positive feeding and includes a cylindrical yarn-supporting periphery covered with a slip-resisting material which exercises a degree of grip on a yarn fed by the wheel. Eyelet guides are positioned for extending the yarn around one-half or a little more of the circumference of the respective feed wheel. The patentee also suggests the possibility but does not disclose a means for adjusting the yarn guide means so that the extent of the lap can be varied. However, although the eyeled guide can be initially adjusted to produce more or less traction and thereby compensate for slackness or excessive tension in a running yarn, the feeder under discussion cannot feed yarn at different rates to meet varying demands as would be needed in a striper or for Jacquard type knitting. This disadvantage, of course, applies to all positive feeding devices.

In U.S. Pat. No. 4,015,447, a further apparatus for positively feeding yarn is disclosed. There, an adjustable pulley or wheel is provided which has a plurality of radially extending circumferentially spaced apart ribs, the ribs of the upper and lower portions of the wheel being receivable within the interspaces of the other wheel. The rate of feeding for each feed unit can be varied by changing the effective diameter of the wheel by varying the axial spacing between the wheels and thereby the intermeshing of the radial rib. The patent teaches a rather elaborate structure for positively feeding yarns. Besides being complicated in construction and expensive to manufacture, the disclosed device shares the same disadvantage as other positive feeders, namely that it cannot be used for feeding on demand as in striper and Jacquard-type knitting. While the feeder of the aforementioned patent as well as some other proposed adjustable positive feeders can regulate the rate of feeding, such feeding is operator adjustable and is not a function of the yarn tension. Such devices, therefore, cannot be considered as compensators which deliver or feed yarn as determined by the tension of the outgoing yarn.

There have also been proposed a number of approaches which vary the rate of feed responsive to the actual tensions in the yarn. Thus, in U.S. Pat. Nos. 1,594,958; 2,542,816 and 2,561,175, the yarn is guided along a particular axial position of abutting, conical gears or rollers by guide arms the positions of which are determined by the tensions in the yarn. Feeding devices of this type share the disadvantage that they do not have a fast enough time response to provide proper operation. Thus, there is time delay involved in riding the yarn from one end to the other end of the conical wheel. Additionally, the guide arms exhibit inertia and cannot substantially instantaneously respond to the very rapid changes or variations in yarn tension. For this reason, such feeding devices cannot be used for high speed operation such as for use in stripers and a jacquard-type knitting.

A positive feed control system for an automatic striper is disclosed in U.S. Pat. No. 3,418,831. Referring to FIGS. 1 and 2, the device of the aforementioned patent is illustrated. Associated with each drum box 10 is a positive feed 12 and feeding fingers 14. Camming design drum inserts are mounted on the rotary striper design drum 18. The fingers may be oriented so as to functionally disengage the yarns 20 or to engage the yarns with the knitting apparatus. The yarns 20 are fed from their associated cones to their appropriate feeds 12, one feed 12 being provided for each yarn 20. The feeds 12 are of the positive wheel type including, in each instance, a free rotating roller or wheel 30 which is drivingly engaged between the opposed retaining flanges thereof by a tape or belt 34. One continuous tape 34 is drivingly engaged with all of the rollers 30 of all the feeds 12 in each tier or circle, each tape being driven from a central pulley about which it is entrained in a conventional manner. The guide arms 50 support guide eyelets 52 which are positioned to cause a portion of the yarn 20 to be positioned between the tape 34 and the roller or wheel 30. It is only when the yarn 20 is moved between the corresponding roller 30 and the tape 34 that a positive frictional gripping of the yarn 20 occurs so as to produce a positive or constant feed of the yarn at a predetermined rate determined by the speed of the tape 34. The feeding device of the aforementioned patent is intended to positive feed with the ability to commence and terminate feeding almost instantaneously. However, such feed control is not by monitoring yarn tension, but by a mechanical finger control device in the drum box 10 as shown. The patentee uses linking rods extending between the fingers and the feed wheel or solenoids actuating circuits wherein the physical movement of the fingers engage an appropriate microswitch and energize the circuit which moves the guide arms 50 and guide eyelets 52 either upwardly or downwardly to commence or terminate positive feeding respectively.

The device under discussion suffers a number of disadvantages. For example, there is a time delay involved in riding the yarn out from under the tape. Accordingly, the device cannot respond to changing yarn demands with sufficient speed.

A further feeding device for knitting machines is described in U.S. Pat. No. 2,658,367. There, the feed wheel or roller is associated with a pair of relatively movable guides arranged to move as a function of yarn tension to change the degree to which the yarn is lapped around the periphery of the feed wheel or roller. However, the patented device requires a smooth surfaced periphery to prevent wrap-around of the yarn about the feed wheel. Accordingly, because the periphery is smooth the device cannot develop the high tractions needed without slipping. Additionally, one of the movable guides is restored to its rest position by a weight which exhibits inertia thus preventing the movable guide from being highly responsive to the high speed oscillations required.

SUMMARY OF THE INVENTION

It is an object of the present invention to provide a yarn feeding device for knitting machines which does not exhibit the disadvantages associated with or inherent in the prior art comparable devices.

It is another object of the present invention to provide a yarn feeding device which is simple in construction and economical to manufacture.

It is yet another object of the present invention to provide a yarn feeding device which is multi-purpose or multi-functional and can be readily used both for positive feeding as well as compensator-type feeding for thread processing machinery and for knitting machines of all types.

It is a further object of the present invention to provide a compensator and a positive thread feeder device which satisfactorily performs the necessary functions for feeding of the yarn at low and substantially constant tension for the proper feeding of yarn to all ribs, Jacquards, stripers, etc. knitting machines, eliminating the deficiencies which heretofore have been experienced in practice.

It is yet a further object of the present invention to provide a yarn feeding device of the type generally discussed above which can accommodate four or more yarns as each feeding station.

To achieve the above objects, as well as others which will become apparent hereafter, the device for feeding of yarn to a yarn processing machine such as a knitting machine in accordance with the present invention includes at least one rotary member mounted for rotation at a feeding station of the knitting machine. Said rotary member is provided about the circumferential periphery thereof with yarn gripping means for frictional engaging yarn during contact therewith. First guide means are provided for guiding at least one yarn to the feeding station and guiding the incoming yarn to said circumferential periphery of said rotary member. Second guide means is provided for guiding the outgoing yarn from said circumferential periphery and to the needles of the knitting machine, said first and second guide means being selectively arranged to cause the yarn to be in contact with a predetermined arcuate length of said circumferential periphery of said rotary member. Drive means are provided for rotating said rotary member. Dynamic adjustment means is provided for engaging the yarn between said first and second guide means for modifying the arcuate length of contact with said circumferential periphery as a function of the input and output tensions in the yarn, whereby the traction or frictional forces imparted to the yarn are modified as a function of the tensions in the yarn to thereby compensate for variations therein.

In accordance with a presently preferred embodiment, said yarn gripping means comprises a generally V-shaped notch or groove formed in said circumferential periphery and said dynamic adjustment comprises a helical spring arranged generally in the plane of said rotary member and the deflection of which is controlled by the yarn tensions with resulting changes in traction imparted to the yarn. The spring also prevents the wrap-around of the yarn around the rotary member.

BRIEF DESCRIPTION OF THE DRAWINGS

The foregoing as well as other objects of the invention will be readily apparent from the detailed description that follows, when taken in conjunction with the drawings in which:

FIG. 1 is a side elevational view of a prior art feed control device for automatic stripers in accordance with the teachings of U.S. Pat. No. 3,418,831;

FIG. 2 is a plan view of the prior art feeder shown in FIG. 1;

FIG. 3 is a side elevational view of a yarn feeding device in accordance with the present invention;

DESCRIPTION OF THE PREFERRED EMBODIMENTS

Figure 4:
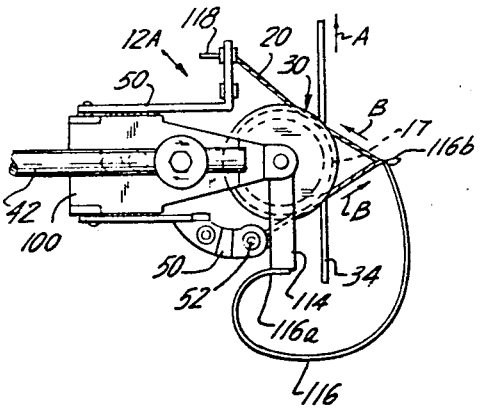
FIG. 4 is a plan view of the feeding device shown in FIG. 3, and showing the yarn tension responsive spring in an extended position.
Figure 5:
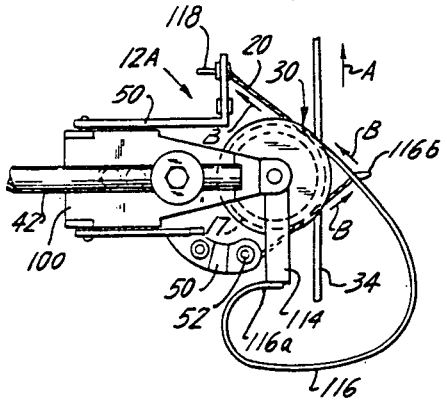
FIG. 5 is a view similar to that shown in FIG. 4, except that the spring is retracted in response to tensions in the yarn.

Referring now to the drawings, in which identical or similar parts are designated by the same reference numerals throughout, and first referring to FIGS. 3–5, the feeding device as a whole is generally designated by the reference numeral 12A.

FIGS. 3–5 have been shown in a manner which will readily indicate the distinctions or differences from the prior art device illustrated in FIGS. 1 and 2. Thus, the solenoid 70 is no longer required, and the guide arm 50 need not be pivoted. As arranged in FIGS. 3–5, the device is useful as a compensating feed control device, as will be more readily apparent from the discussion that follows. The compensating feed device 12A includes a mounting member 100 which may be connected to the knitting machine in a conventional manner. As best shown in FIGS. 4 and 5, there is provided a spring support member 114 which extends from the mounting member 100 and supports a spring 116. The spring 116 may be of any suitable type, such as a leaf spring or a helical spring made from piano wire.

The spring 116 includes a fixed end **116*a* which is fixed to the spring support member 114, and a free end 116*b* which is formed with a suitable hook for engaging the yarn 20** as will be more fully described hereafter.

Figure 6:
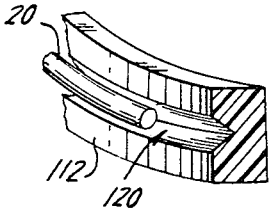
FIG. 6 is a perspective view of a portion of the circumferential periphery of one type of rotary member which can be used in conjunction with the present invention, showing the gripping means for frictionally engaging the yarn to comprise a V-shaped groove.

One of the guide arms 50 supports a guide eyelet 52, while a second arm supports a further guide eyelet 118. The rotary member or roller 30 has a circumferential periphery 120 which is provided or formed with yarn gripping means for frictionally engaging the yarn 20 during contact therewith. The friction means used can be of any suitable type which will provide a predetermined amount of traction. In the presently preferred embodiment shown in FIG. 6, for example, the means for producing the friction is in the nature of a V-shaped groove which receives the yarn. One advantage of using a V-shaped groove is that the greater the tensions which are imparted to the threads, the more the threads are wedged into the V-shaped groove and, consequently, the greater the frictional forces and traction applied to the thread. Accordingly, such friction producing means is unlike those in most prior art feeding devices which produce slipping when yarn tensions are elevated. With V-shaped grooves, however, the greater the tension, also the greater the friction or traction to thereby minimize or eliminate slipping.

Figure 7:
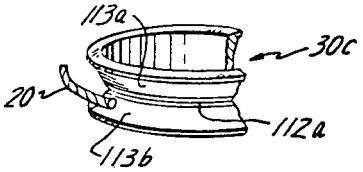
FIG. 7 is similar to FIG. 6, but showing a modified groove of continually decreasing height.
Figure 8:
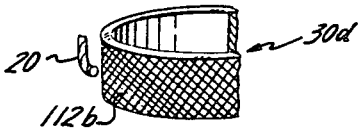
FIG. 8 is similar to FIGS. 6 and 7, except that the frictional surface for engaging the yarn is provided by cross-hatching or knurling the circumferential periphery of the rotary member.
Figure 9:
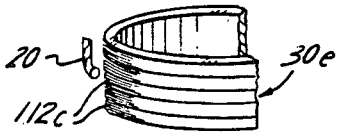
FIG. 9 is similar to FIGS. 6–8, but the the friction for the yarn is produced by a plurality of circumferential ribs.
Figure 10:
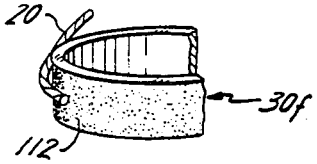
FIG. 10 is similar to FIGS. 6–9, the frictionally engaging surface for the yarn being produced by a rubberized surface.
Figure 11:
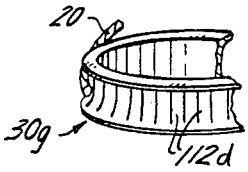
FIG. 11 is similar to FIGS. 6–10, the friction here being produced by a plurality of generally axial ribs formed on a generally concave surface.
Figure 12:
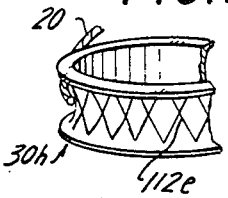
FIG. 12 is similar to FIGS. 6–11, but the friction here being produced by cross-hatching or knurling on a generally concave outwardly facing surface.

Numerous other friction producing surfaces can be used for producing the requisite traction. In FIG. 7, for example, a modified V-shaped groove is shown wherein the height of the groove does not linearly decrease in the radially inward direction, the groove being formed by upper and lower curved guide surfaces **113*a*, 113*b* which guide the yarn into a V-shaped groove which at least partially wedges the same. In FIGS. 8–12, further examples of friction producing surfaces are illustrated which can also be used, with varying degrees of advantage. In FIGS. 8 and 12, cross-hatched or knurled surfaces are shown, while in FIGS. 9 and 11**, circumferential and axial grooves are shown respectively. In FIG.

10, the peripheral surface of the rotary member is shown to be in the nature of a rubberized surface.

Figure 13:
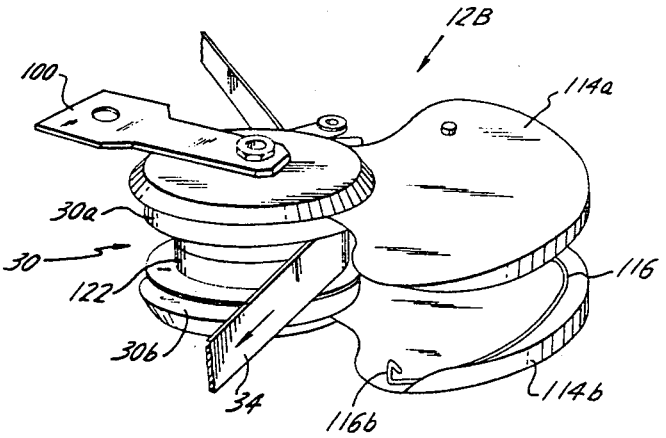
FIG. 13 is a perspective view of a presently preferred embodiment of the present invention, as viewed from one side thereof.
Figure 14:
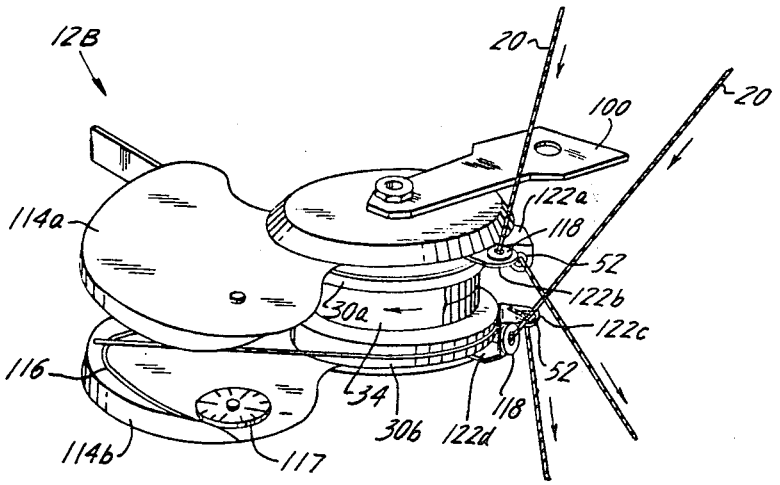
FIG. 14 is similar to FIG. 13, but showing the preferred embodiment from the other side thereof.
Figure 18:
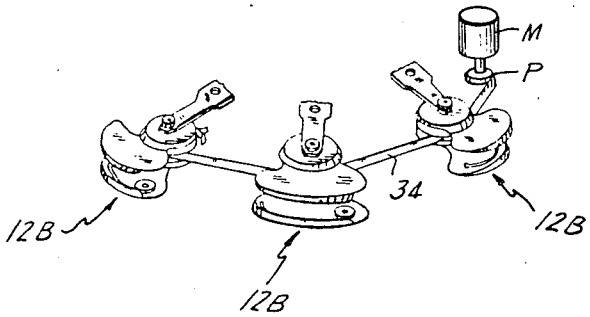
FIG. 18 is a schematic representation of the manner in which a plurality of feeding devices in accordance with the present invention cooperate when placed at the feeding stations of a knitting machine.

Referring to FIGS. 13 and 14, a presently preferred embodiment of the invention is shown and designated by the reference numeral 12B. Here, the roller 30 is shown to include upper and lower rollers or wheels 30*a* and 30 *b* having generally V-shaped grooves of the type shown in FIG. 7. The rollers 30*a* and 30*b* are coaxially arranged and spaced from each other to allow for a pulley portion 122 which is adapted to be engaged by the drive belt or tape 34 which may be driven by a motor M and pulley wheel P (see FIG. 18).

Connected to the mounting member 100 is an upper spring support member 114*a* and a lower spring support member 114*b*. A spring element 16 is attached to each spring support member in any conventional manner to arrange the spring substantially in the plane of a yarn receiving roller or wheel.

Referring to FIG. 14, the spring 116 is shown to be connected to the lower spring support member 114*b*. Such connection may be conventional, although it is presently preferred that the spring be attached to the spring support member by means of an adjustable spring retainer 117 which is calibrated to selectively adjust the pre-tensions on the spring 116, for reasons which will become apparent hereafter.

The incoming yarns are guided by eyelets 52 and guide arms or adjustment members 122*a* and 122*c*, while the eyelets 118 are provided on adjustment members 122*b* and 122*d*. The eyelets are arranged for guiding the incoming yarn to the circumferential periphery of one of the respective or associated wheels or rollers and for guiding the outgoing yarn from the circumferential periphery and to the needles of the knitting machine.

Figure 15:
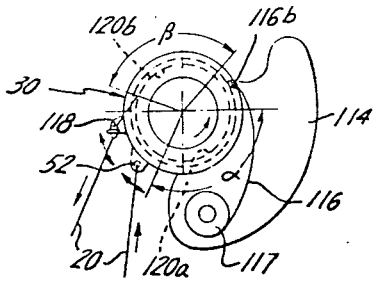
FIG. 15 is a schematic representation of the feeding device shown in FIGS. 13 and 14, with one of the spring support members or plates removed to illustrate the operation thereof.
Figure 16:
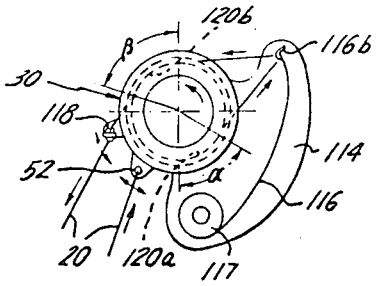
FIG. 16 is similar to FIG. 15, but showing the spring in an extended position thereof.

Referring now to FIGS. 15 and 16, the operation of the device of the present invention will now be described when used as a compensating feeding device.

With the yarn coming through the eyelet 52 and leaving through the eyelet 118 at very high tension, the yarn 20 is wrapped or turned substantially about the entire periphery of the roller 30, rotation of the roller imparting traction or frictional forces to the yarn. With the spring 116 pre-tensioned, the spring portion or hook 116*b* of the spring is made to engage the yarn between the eyelets 52 and 118 to divide the arcuate length of contact into an initial or first contacting peripheral portion 120*a* and a second contacting peripheral portion 120*b* which respectively subtend angles $\alpha$ and $\beta$. The pre-tensioning of the spring, and the spring constants are selected to move the spring 116 to its normal or extended position shown in FIG. 16 when little or no tension is applied to the yarn. In this condition, the spring pulls a portion of the yarn which would normally be in contact with the circumferential periphery of the roller away from the circumferential periphery to thereby decrease the overall surface or length of contact between the yarn and the wheel or roller including the contacting portions 120*a* and 120*b* and the angles $\alpha$ and $\beta$. This decreased contact and tension, of course, reduces the frictional forces applied to the yarn and thereby reduces or eliminates the traction.

Referring to FIG. 15, as soon as a slight tension is applied to the output yarn, the tension is transmitted to the second contacting peripheral portion 120*b* producing additional traction and tension in the yarn thereby flexing the spring 116 almost instantaneously towards the roller or wheel 30 and still further increasing the surfaces of contact and traction. As will be evident from FIG. 15, substantially the entire yarn between the eyelets 52 and 118 is now in contact with the roller periphery. This increases the frictional forces applied to the yarn and thereby the traction by which it can compensate for the externally applied forces to the yarn.

An important feature of the present invention is that the adjustment mechanism is yarn tension responsive. By maintaining the mass of the spring at the minimum possible amount, the spring has very little inertia and it can be very responsive to very rapid changes in the yarn tension. With the arrangement of the present invention, therefore, the greater the tension applied to the yarns, the greater the peripheral surface which makes contact with the yarn and the greater the traction. On the other hand, as soon as tension on the yarns decreases, the spring almost instantaneously extends to its normal and rest condition, and the traction is reduced accordingly. The partition of the yarn-contacting surface by at least one hook into two contacting peripheral portions allows the use of high frictional rollers or wheels because the spring hooks prevent wrap-around of the yarn.

Figure 17:
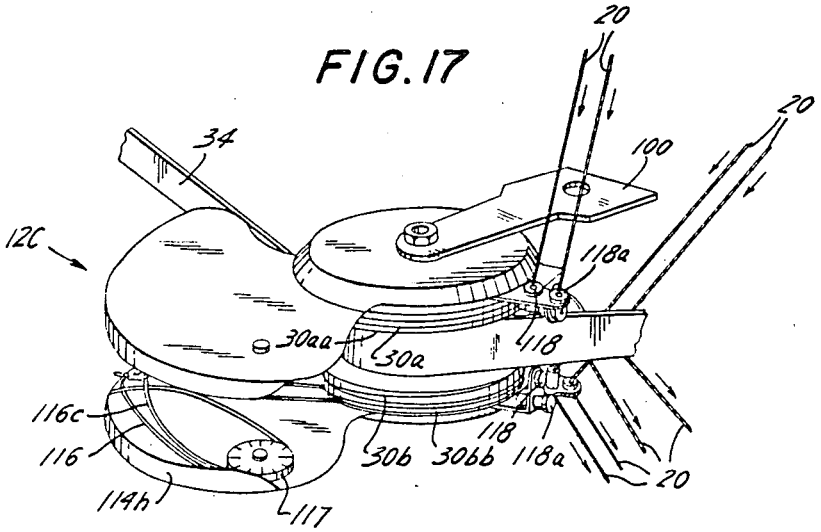
FIG. 17 is similar to FIGS. 13 and 14, but showing a modification of the preferred embodiment.

In FIG. 17, the feeder of the present invention shown in FIGS. 13 and 14 is slightly modified. While the feeding device 12B can accommodate two yarns, one in the upper roller 30*a* above the pulley portion 122, and the second yarn in the lower roller 30*b*, the modified embodiment 12C shown in FIG. 17 can accommodate four yarns, an additional wheel 30*aa* being placed above the wheel 30*a*, and a further wheel 30*bb* disposed proximate to the wheel 30*b*. Two additional springs are provided one for each of the additional wheels, such as spring 116*c* in FIG. 17. Of course, additional guide means such as eyelets 118*a* must be added for guiding the additional yarns towards and away from the additional wheels. However, irrespective of the number of stacked feeder wheels and the number of yarns accommodated at each feeding station, the principle of operation is the same for all the wheels.

Because the springs 116 automatically adjust to the tensions in the yarns for modifying the amount of traction imparted thereto, the springs may be considered to be in the nature of a dynamic adjustment means, the position of the spring constantly changing during operation to almost instantaneously accommodate variations in yarn tensions. While the use of a spring is the presently preferred mode for the dynamic adjustment means, it should be understood that other forms of dynamic adjustment means may be possible. Any dynamic adjustment means which can substantially instantaneously modify the degree of contact between a yarn and an associated friction wheel can be used. However, it is only important that such dynamic adjustment means have little inertia and can respond substantially instantaneously to variations in yarn tension.

Referring to FIGS. 15 and 16, it is advantageous that the guide eyelets 52 and 118 be adjustable positionable relative to each other about the axis of the rollers or wheels 30. Such adjustable movements of the guide eyelets on the adjustment members 122*a*–122*d* is represented or suggested by the circumferentially directed arrows. As with the above-described action of the spring 116, which modifies the degree of contact between the yarn and the wheel peripheries, the relative positions of the eyelets have similar effects. Thus, separation of the eyelets from each other effectively decreases the area of contact between the yarn and the wheel 30, thereby decreasing the traction imparted to the yarn. The positions of the guide eyelets which optimize traction are, of course, when the eyelets are as close as possible to each other. Although the basic structure of the feeder mechanism of the present invention is relatively simple, there exists numerous ways in which to adjust the friction between the drive wheels or rollers and the yarn. As noted, the surface and the materials about the circumferential peripheries of the wheels may be changed. Additionally, springs having different constants to thereby require greater or smaller tensions in the yarns to deflect the same may be selected. Also, the relative positions of the guide eyelets may be adjusted. Also, the springs may be pre-tensioned by use of suitable adjustable spring retainers. The technician initially adjusting the machine may make the necessary adjustments as he deems best. However, the adjustments should be made so as to produce traction during normal operation but which produces slipping when the tension in the yarn is approximately two to three grams below the breaking point of the yarn being used.

While the above discussed figures illustrate the invention using the spring, to provide direct drive compensating feeding, it should be readily evident that non-use of the spring permits the device to be used as a conventional direct drive feeder which feeds the yarn in synchronism with the operation of the machine. On the other hand, when using the spring to function as a compensating feeder, the frictional wheels or rollers are advantageously rotated at a speed higher than that of the knitting machine, and preferably at a speed which is at least twenty percent higher than the knitting machine speed. As noted, positive feeding is attained just by synchronizing the speed of the rollers to the same speed at which the yarn is required to feed the knitting needles.

The device, as noted, is also extremely flexible, allowing for numerous adjustments to establish the base or nominal output tensions.

For striping, the present invention can be used as a compensator or as a positive precise yarn control feeding device on any machine with variable stripe attachment where ends are taken in and out of action. For Jacquards, the invention allows the yarn to be fed through the needles with compounded uniform low tension at any of the constant speed variations of the feeding yarn, equalizing and compensating at the same time, all unequal and excessive tensions caused by the yarn package, etc.

What is claimed is:

1. In a device for feeding of yarn to a yarn processing machine such as a knitting machine, at least one rotary member mounted for rotation at a feeding station of the knitting machine, said rotary member being provided about the circumferential periphery thereof with yarn gripping means for frictionally engaging yarn during contact therewith; first guide means for guiding at least one yarn to the feeding station and guiding the incoming yarn to said circumferential periphery of said rotary member; second guide means for guiding the outgoing yarn from said circumferential periphery and to the needles of the knitting machine, said first and second guide means being selectively arranged to cause the yarn to be in contact with a predetermined arcuate length of said circumferential periphery of said rotary member; drive means for rotating said rotary member; and dynamic adjustment means engaging the yarn between said first and second guide means for modifying the arcuate length of contact with said circumferential periphery as a function of the input and output tensions in the yarn, whereby the traction or frictional forces imparted to the yarn are modified as a function of the tensions in the yarn to thereby compensate for variations therein.

2. In a device as defined in claim 1, wherein a plurality of rotary members are provided at the feeding station, each rotary member having associated therewith independent guide means and dynamic adjustment means.

3. In a device as defined in claim 1, wherein said rotary member has a pulley portion generally coaxially arranged with said circumferential periphery, said drive means comprising an endless belt in engagement with said pulley portion and actuated by the yarn processing machine.

4. In a device as defined in claim 1, wherein said yarn gripping means comprises a generally V-shaped notch or grove.

5. In a device as defined in claim 4, wherein said circumferential periphery has a generally circular concave cross-section, said V-shaped notch or groove being provided in the circular surface to form symmetrical guide surfaces for guiding the yarn into said V-shaped notch or groove when tension is applied to the yarn.

6. In a device as defined in claim 1, wherein said yarn gripping means comprises an elastomeric material.

7. In a device as defined in claim 1, wherein said yarn gripping means comprises a metallic material.

8. In a device as defined in claim 1, wherein said yarn gripping means comprises a knurled surface.

9. In a device as defined in claim 1, wherein said yarn gripping means comprises a ribbed surface.

10. In a device as defined in claim 1, wherein said guide means comprises eyelets mounted proximate to said rotary member.

11. In a device as defined in claim 10, wherein said eyelets are positioned radially outwardly of said rotary member and generally in the plane thereof.

12. In a device as defined in claim 11, further comprising adjustment members on which said eyelets are arranged, said adjustment members being mounted for rotation about the axis of rotation of said rotary member.

13. In a device as defined in claim 1, wherein said dynamic adjustment means comprises resilient means having a yarn engaging portion normally biasing a portion of the yarn away from said circumferential periphery, tensions on the yarn causing said yarn engaging portion to move towards said circumferential periphery against the action of said resilient means.

14. In a device as defined in claim 13, wherein said resilient means comprises at least one spring.

15. In a device as defined in claim 14, wherein said spring is a helical spring arranged generally in the plane of said rotary member.

16. In a device as defined in claim 13, further comprising pre-tensioning means for adjusting the restoring forces exhibited by said resilient means when moved by the tensioned yarn from the normal or rest position of said resilient means.

17. In a device as defined in claim 1, wherein said yarn gripping means comprises a porcelain material.

18. In a device as defined in claim 1, wherein said rotary member has a pulley portion generally coaxially arranged with said circumferential periphery, said drive means comprising an endless belt in engagement with said pulley portion; and motor means for actuating said endless belt, the operation of which is independent of said yarn processing means.

* * * * *